US007438112B2

(12) United States Patent
Cheng

(10) Patent No.: US 7,438,112 B2
(45) Date of Patent: Oct. 21, 2008

(54) ROLL-UP BARRIER

(76) Inventor: Shu-Chen Cheng, 10F, No. 29-5, Sec. 2, Chung Cheng E. Rd., Tamshui Chen, Taipei Hsien (TW)

( * ) Notice: Subject to any disclaimer, the term of this patent is extended or adjusted under 35 U.S.C. 154(b) by 193 days.

(21) Appl. No.: 11/604,922

(22) Filed: Nov. 28, 2006

(65) Prior Publication Data

US 2008/0121354 A1 May 29, 2008

(51) Int. Cl.
*A47H 1/00* (2006.01)

(52) U.S. Cl. ..... 160/24; 160/301; 242/385.4; 248/67

(58) Field of Classification Search ..... 160/24, 160/23.1, 368.1, 290.1, 301, 302, 303, 304.1, 160/323.1; 248/67; 242/385.4
See application file for complete search history.

(56) References Cited

U.S. PATENT DOCUMENTS 5,275,220 A * 1/1994 Siegal ..... 160/24
5,690,317 A * 11/1997 Sandsborg ..... 256/1
6,012,504 A * 1/2000 Siegal ..... 160/24
6,375,165 B1 * 4/2002 Sherratt et al. ..... 256/24
6,502,778 B2 * 1/2003 Kim ..... 242/385.4
6,536,502 B2 * 3/2003 Britto et al. ..... 160/23.1
6,907,914 B1 * 6/2005 Lundh ..... 160/301
7,178,792 B2 * 2/2007 Monahan et al. ..... 256/73
7,219,709 B1 * 5/2007 Williams ..... 160/24

* cited by examiner

*Primary Examiner*—Blair M. Johnson
(74) *Attorney, Agent, or Firm*—William E. Pelton, Esq.; Cooper & Dunham LLP

(57) ABSTRACT

A roll-up barrier has a base, an end cap, a drive shaft connected between the base and the end cap, a rolling assembly, a resilient element and a flexible barrier. The end cap has an arresting mechanism having a control button and an arrestor. The rolling assembly is mounted rotatably around the drive shaft and has a rolling bushing. The rolling bushing has an actuator and multiple one-way arresting teeth. The resilient element provides a reposition force for rolling back the rolling assembly. The flexible barrier is mounted retractably around the rolling assembly. When the control button is pressed and rotated, the actuator detaches the arrestor from the arresting teeth to allow rotation of the rolling assembly. When the control button is released, the arrestor engages the arresting teeth to prevent the rolling assembly from rotation so the flexible barrier can be pulled out and held at a desired length.

9 Claims, 12 Drawing Sheets

ROLL-UP BARRIER

BACKGROUND OF THE INVENTION

1. Field of the Invention

The present invention relates to a roll-up barrier, and more particular to a roll-up barrier that has a flexible barrier can be pulled out and held at a desired length and can be conveniently retracted.

2. Description of Related Art

A safe zone in which an infant or a pet can play to limit access to hazardous areas is defined with a temporary barrier or gate mounted between two walls or in a doorway.

For make storage convenient, various kinds of roll-up barriers have been developed. Generally, a conventional roll-up barrier has a rolling tube, a flexible barrier and a resilient element. The rolling tube is positioned on a stationary, e.g. a wall, a doorjamb or the like. The flexible barrier is mounted around the rolling tube and has a proximal edge and a distal edge. The proximal edge of the flexible barrier is mounted securely on the rolling tube. The distal edge of the flexible barrier can be pulled out to rotate the rolling tube and to be connected to and positioned on a hook which is mounted on an adjacent stationary, e.g. a wall, a doorjamb or the like, such that the flexible barrier can define a safe zone in which an infant or pet can play. The resilient element is mounted in the rolling tube to provide a rotating reposition force to roll back the rolling tube after the rolling tube is rotated, such that the flexible barrier can be rapidly and conveniently rolled back around the rolling tube.

However, when the distal end of the flexible barrier is collided with something or someone, or is pulled or dragged by the infant or the pet to be inadvertently detached from the hook on the stationary, the flexible barrier will be entirely retracted back around the rolling tube. During retraction of the flexible barrier, retracting force of the moving flexible barrier may hurt the infant or the pet. Additionally, to pull out the flexible barrier to reconnect the distal end thereof to the hook on the adjacent stationary is inconvenient.

SUMMARY OF THE INVENTION

The main objective of the present invention is to provide a roll-up barrier to overcome the aforementioned problems of the conventional roll-up barrier.

A roll-up barrier has a base, an end cap, a drive shaft connected between the base and the end cap, a rolling assembly, a resilient element and a flexible barrier. The end cap has an arresting mechanism has a bottom, a control button, a spring and an arrestor. The control button has a bottom and multiple control serrations formed on the bottom of the control button. The spring is mounted under the control button to slightly press up the control button. The arrestor is mounted under the bottom of the end cap and is capable of moving along longitudinal direction.

The rolling assembly has a rolling tube and a rolling bushing. The rolling tube is mounted rotatably around the drive shaft and has a top end. The rolling bushing is mounted at the top end of the top end of the rolling tube and has a top, an actuator and multiple one-way arresting teeth. The actuator is mounted rotatably on the top of the rolling bushing to engage the control serrations to rotate simultaneously with the control button when the control button is pressed down, and to depart from the control serrations when the control button is released. When the actuator rotates in a specific direction, the arrestor is lifted up by the actuator. The one-way arresting teeth are formed on the top of the rolling bushing around the actuator to engage with the arrestor to prevent the rolling bushing from rotation when the arrestor moves down, and to depart from the arrestor to allow rotation of the rolling bushing when the arrestor is lifted up by the actuator.

The resilient element is mounted in the rolling tube to provide a rotating reposition force for rolling back the rolling tube. The flexible barrier is mounted retractably around the rolling tube. When the control button is pressed and rotated, the actuator detaches the arrestor from the arresting teeth and rotation of rolling assembly is allowed. Such that a user can pull out or retract the flexible barrier. When the control button is released, the arrestor engages the arresting teeth and prevents the rolling assembly from rotation. Such that a desired length of the flexible barrier can be pulled out and kept in outside of the rolling tube.

Accordingly, even if the flexible barrier is inadvertently detached from a stationary, e.g. a wall, doorjamb or the like, to which the flexible barrier is attached, the flexible barrier does not retracted by the resilient element and is still held at the original length to prevent an infant or the pet from being injured by the retracting flexible barrier. Additionally, the user can immediately and conveniently reconnect the flexible barrier to the stationary.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
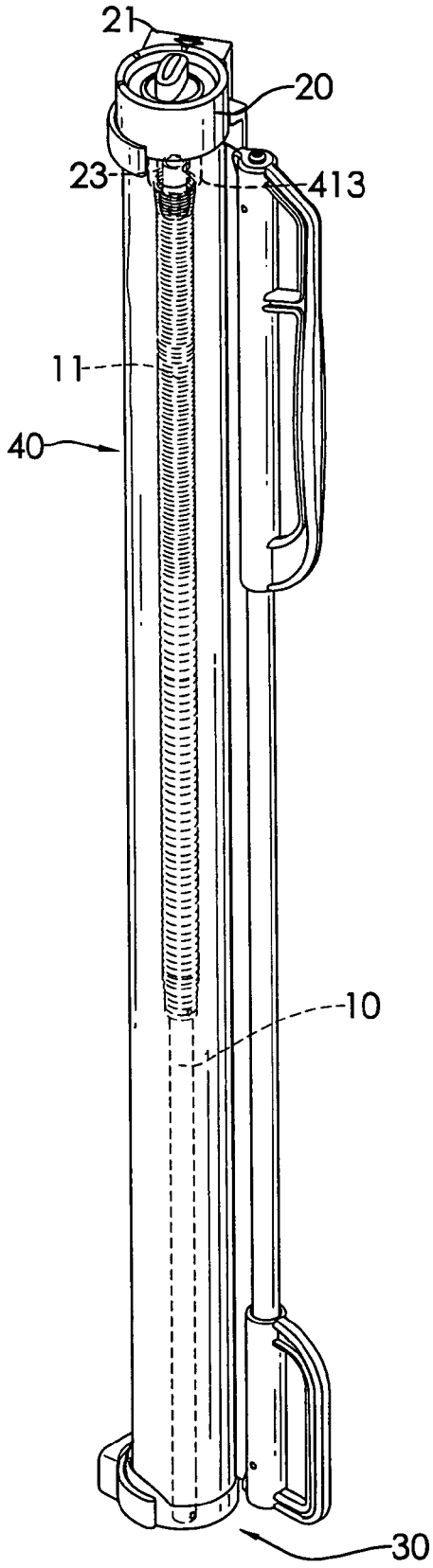
FIG. 1 is a perspective view of a roll-up barrier in accordance with the present invention.
Figure 2:
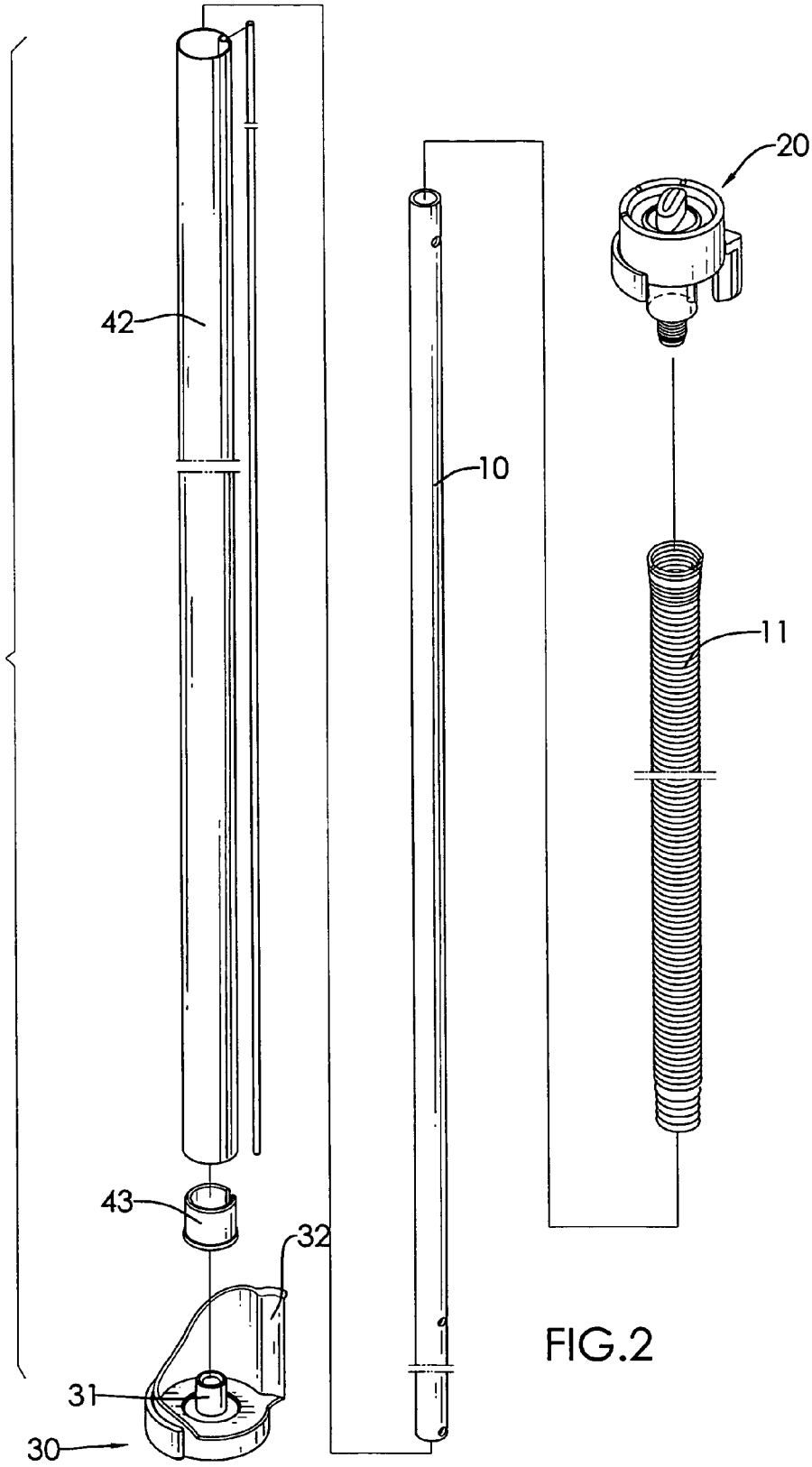
FIG. 2 is an exploded perspective view of the roll-up barrier in FIG. 1.

With reference to FIGS. 1-4, a roll-up barrier in accordance with the present invention comprises a base (30), a drive shaft (10), an end cap (20), a rolling assembly (40), a resilient element (11) and a flexible barrier (50).

Figure 3:
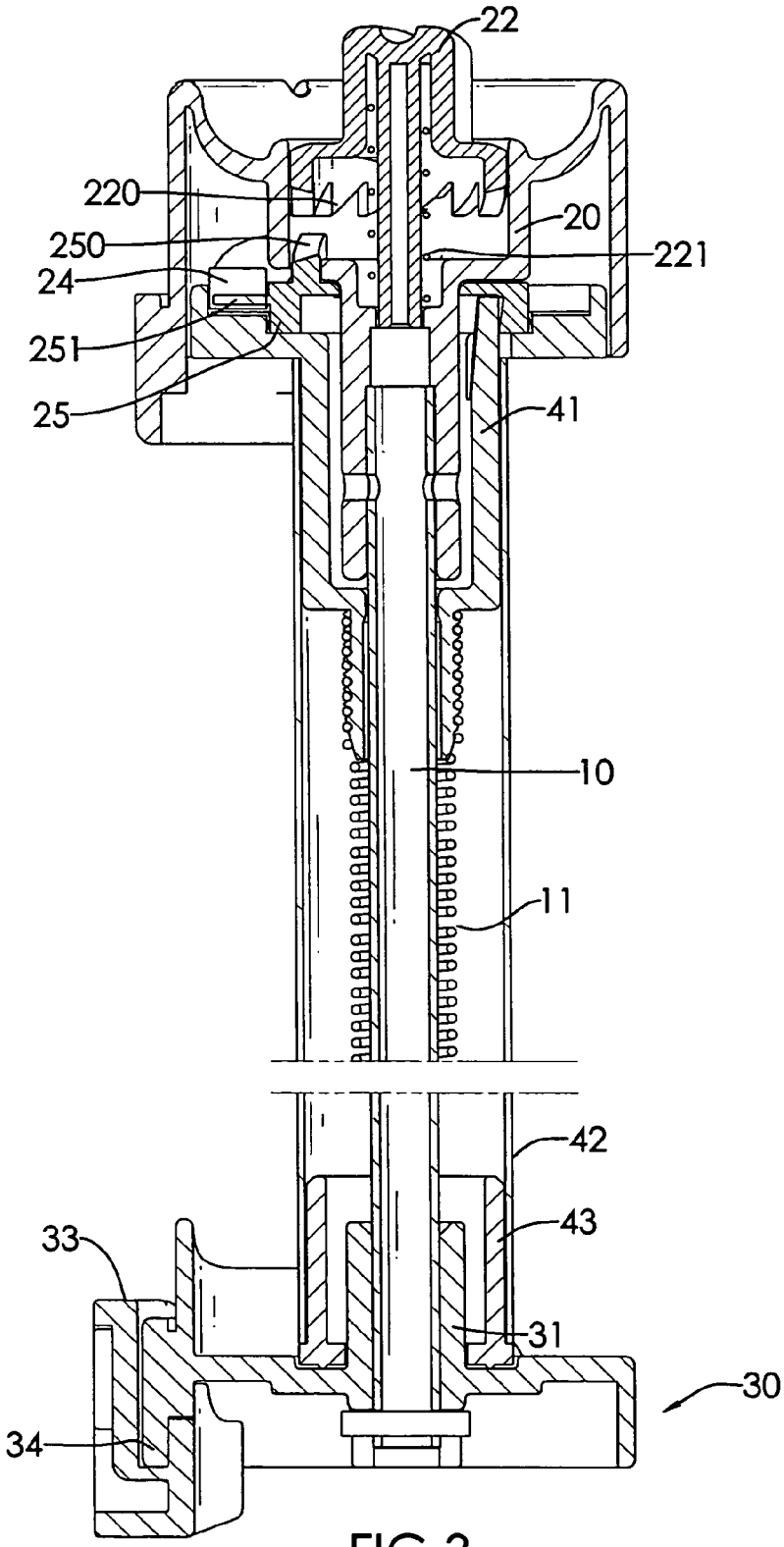
FIG. 3 is a cross-sectional front view of the roll-up barrier in FIG. 1.

The base (30) has a top surface, an outer edge, a connecting tube (31), an optional guide tab (32), an optional connecting lip (34) and an optional base connector (33). The connecting tube (31) is formed on and protrudes up from the top surface of the base (30). The guide tab (32) is formed on and protrudes up from the top surface of the base (30) and is mounted around the connecting tube (31). With further reference to FIG. 3, the connecting lip (34) is curved, is mounted around the outer edge of the base (30), forms a curved gap (341) between the outer edge of the base (30) and the connecting lip (34) and has a proximal end. The proximal end of the connecting lip (34) is formed on and protrudes radially from the outer edge of the base (30). The base connector (33) is mounted detachably on the outer edge of the base (30), attaches to a stationary, e.g. a wall (not shown), a doorjamb (not shown) or the like, to hold the base (30) on the stationary and has an inside surface, multiple optional through holes (331), multiple optional fasteners (not shown) and an optional connecting groove (330). The fasteners extend respectively through the through holes (331) and attach to the stationary to connect the base connector (33) to the stationary. The connecting groove (330) is formed in the inside surface of the base connector (33) to selectively hold the connecting lip (34) of the base to mount the base (30) on the base connector (33).

The drive shaft (10) has a bottom end and a top end. The bottom end of the drive shaft (10) is mounted securely in the connecting tube (31) of the base (30).

The end cap (20) is mounted securely at the top end of the drive shaft (10) and has a bottom surface, an outer edge, a connecting tube (23), an arresting mechanism, an optional guide tab (200), an optional connecting lip (201) and an optional end cap connector (21). The connecting tube (23) is formed coaxially on and protrudes down from the bottom surface of the end cap (20) and securely holds the top end of the drive shaft (10).

Figure 4:
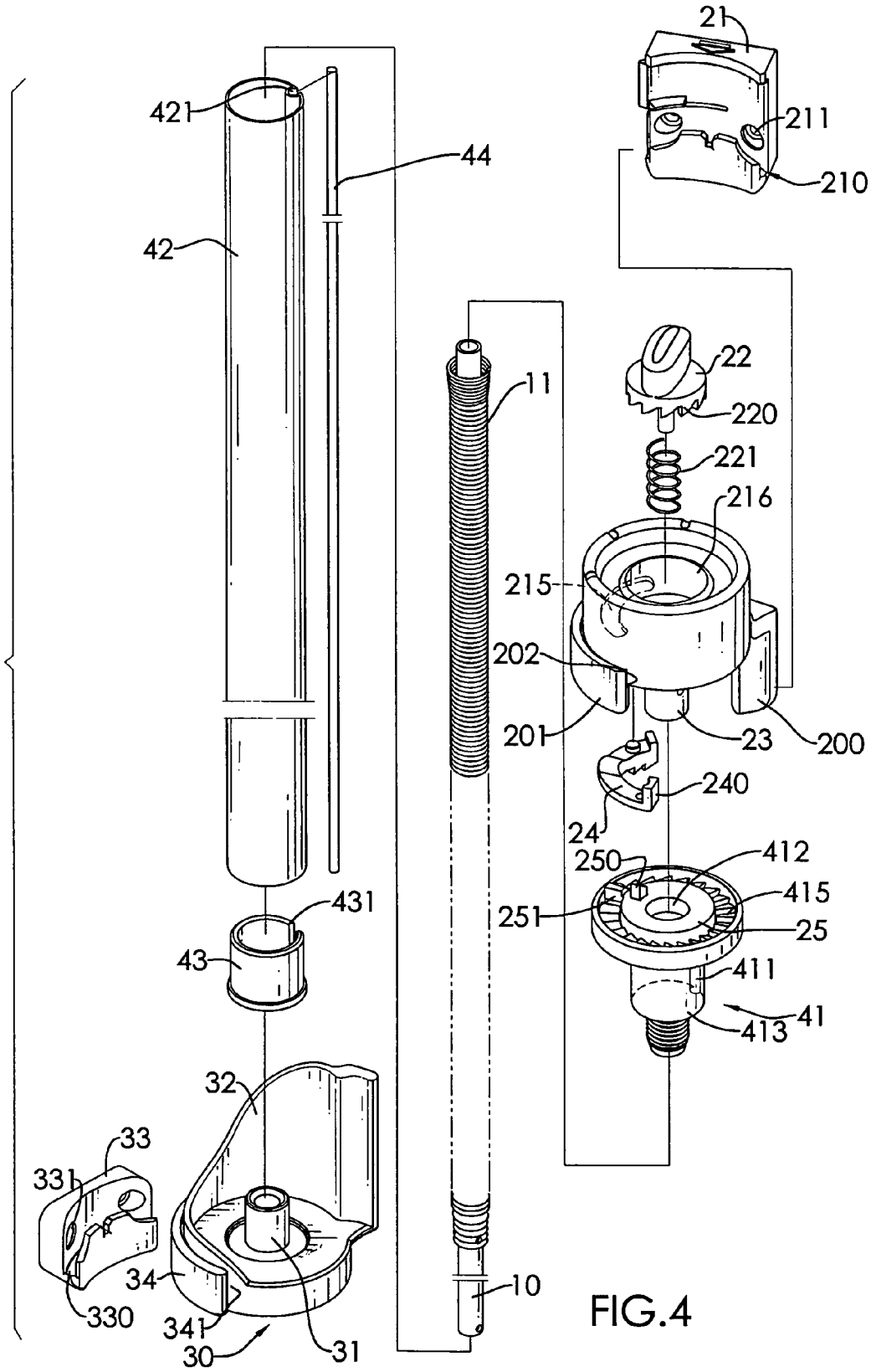
FIG. 4 is an enlarged exploded perspective view of the roll-up barrier in FIG. 1.
Figure 5:
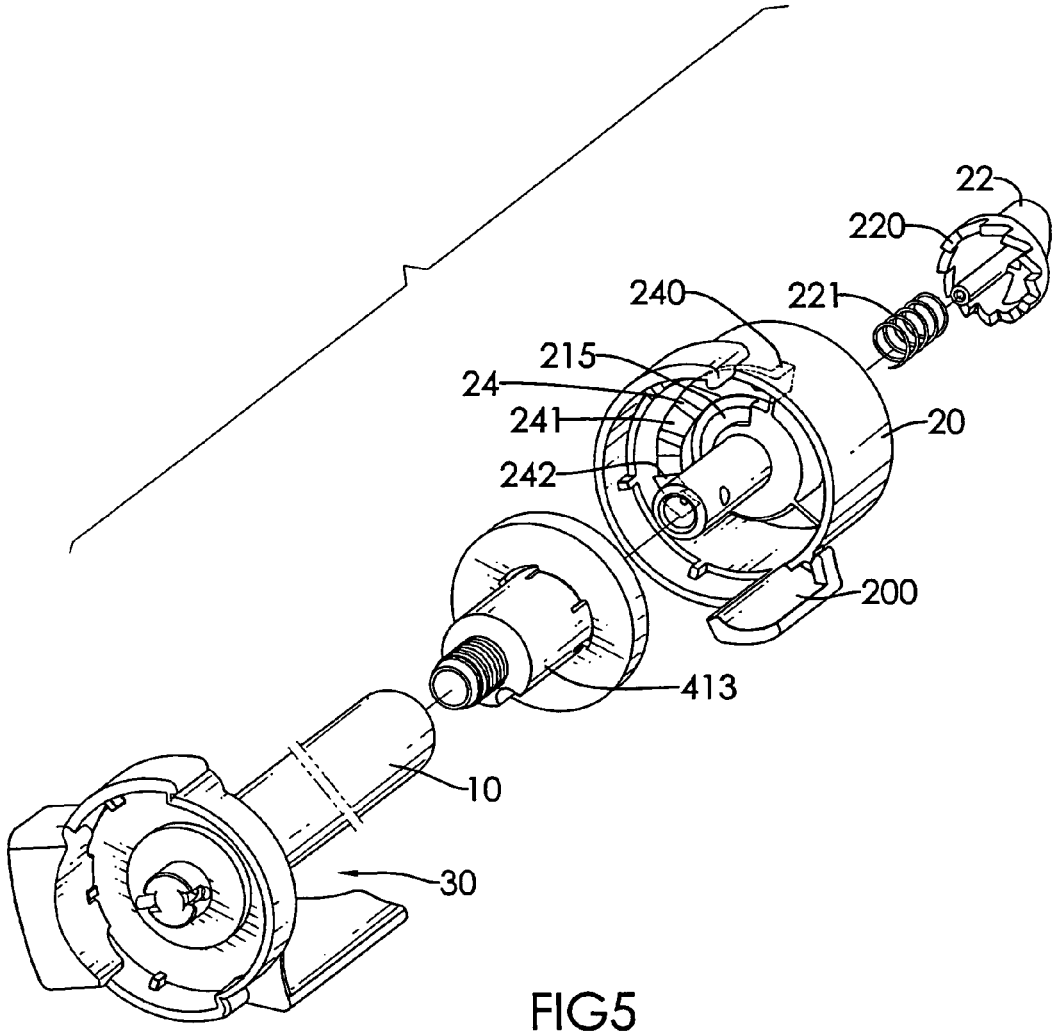
FIG. 5 is an exploded perspective view of a top portion of the roll-up barrier in FIG. 1.
Figure 6:
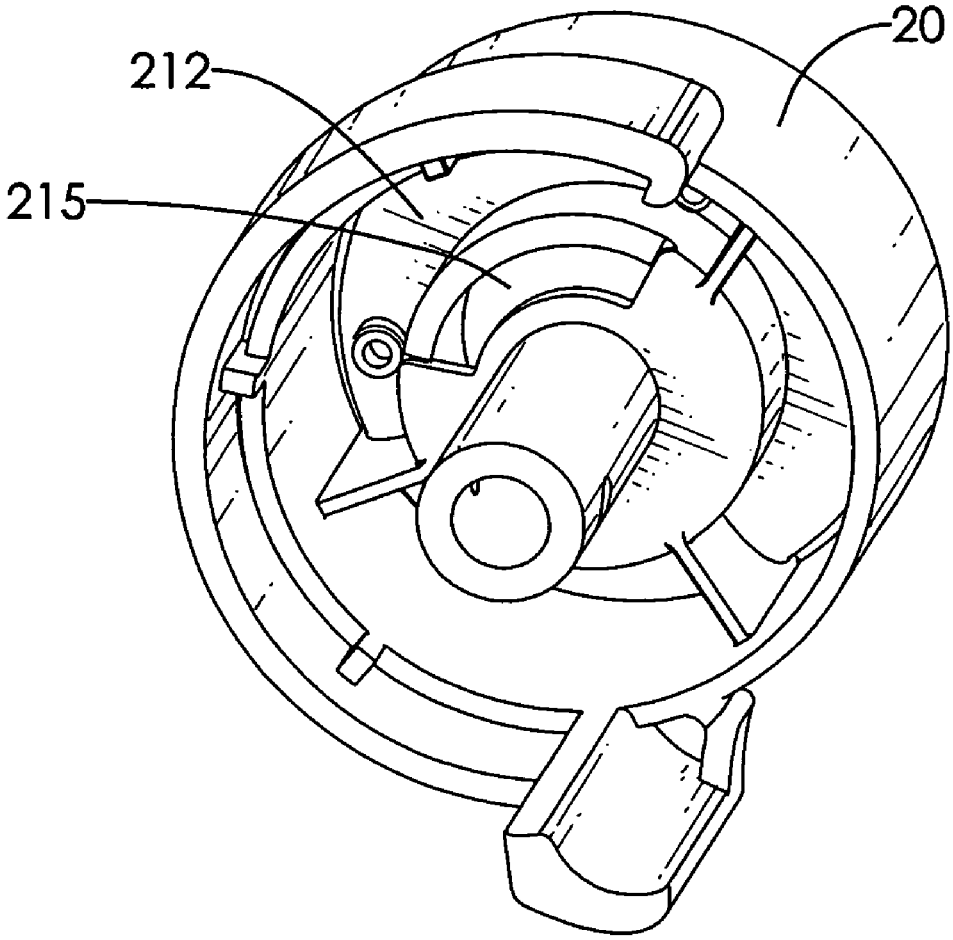
FIG. 6 is a perspective view of an end cap of the roll-up barrier in FIG. 1.

With further reference to FIGS. 4-6, the arresting mechanism is mounted in the end cap (20) and has a button recess (216), a control button (22), a spring (221), a limit slot (215), an optional receiving recess (212) and an arrestor (24). The button recess (216) is formed in the end cap (20), has an open top and a bottom and may communicate with the connecting tube (23) of the end cap (20). The control button (22) is mounted rotatably in the button recess (216) and has a bottom, an optional positioning rod and multiple control serrations (220). The positioning rod is formed on and protrudes down from the bottom of the control button (22) and may insert into the connecting tube (23) of the end cap (20). The control serrations (220) are formed circularly on the bottom of the control button (22) and may be formed around the positioning rod.

Figure 7:
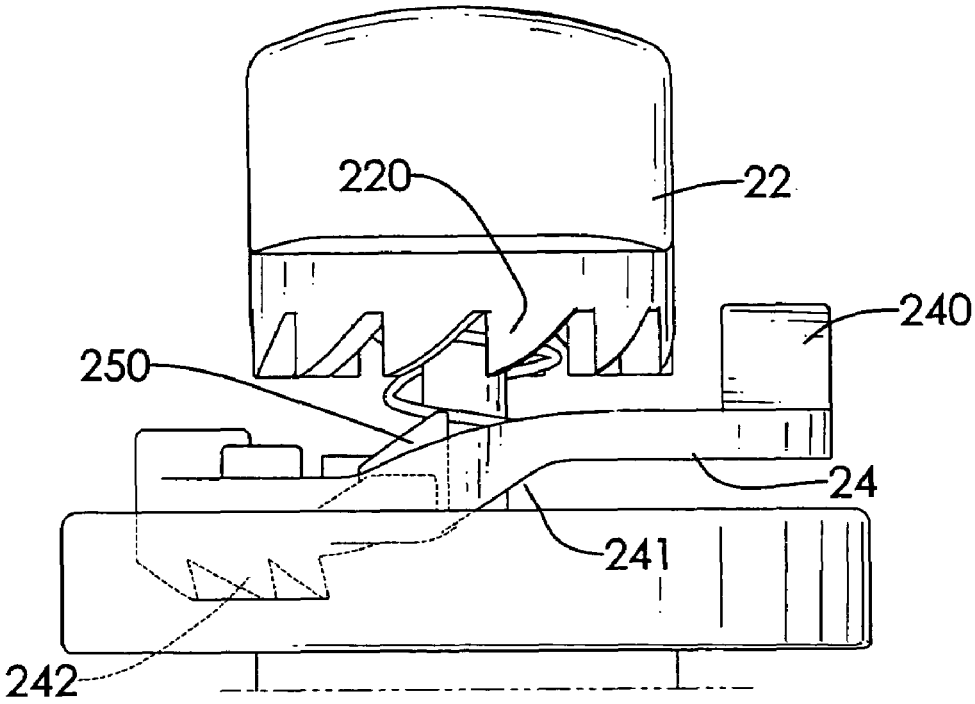
FIG. 7 is a front view of an arresting mechanism of the roll-up barrier in FIG. 1.

With further reference to FIG. 7, the spring (221) is mounted under the bottom of the control button (22) to press the control button (22) up slightly and may be mounted around the position rod of the control button (22).

The limit slot (215) is curved, is formed through the bottom of the button recess (216), aligns with the control serrations (220) and has two ends. The receiving recess (212) is formed in the bottom surface of the end cap (20) around the button recess (216) and has an inner wall.

Figure 8:
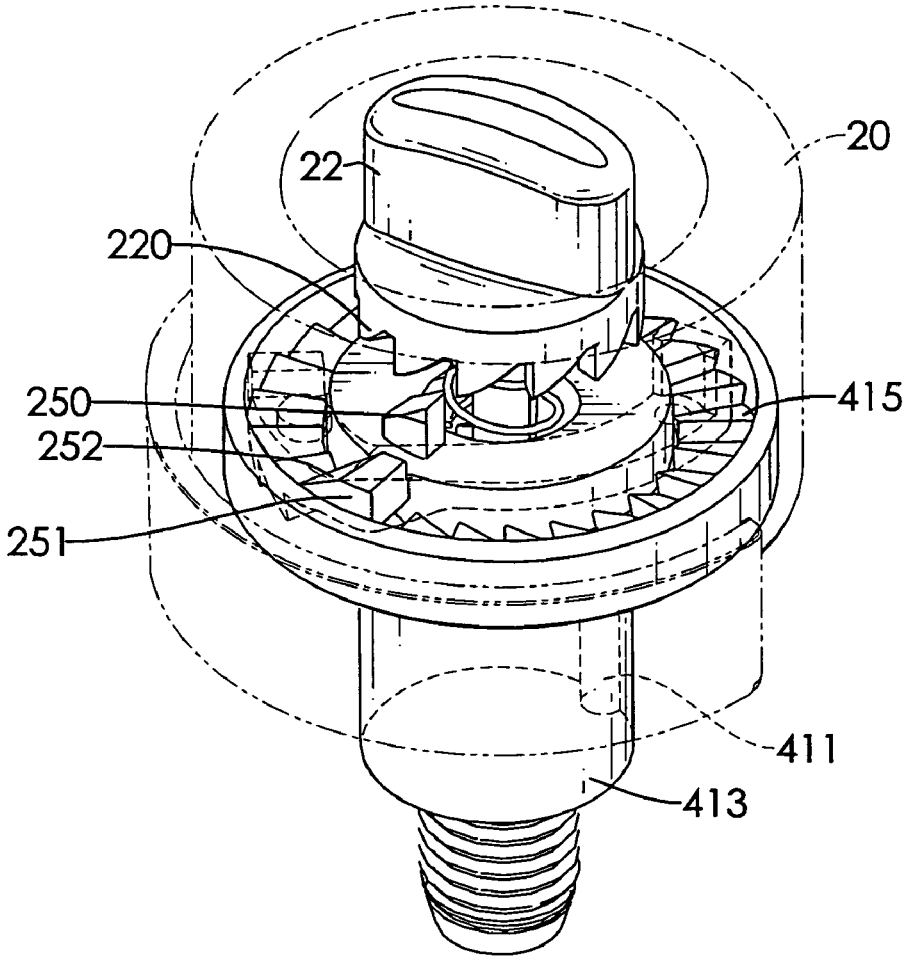
FIG. 8 is a perspective view of the arresting mechanism of the roll-up barrier in FIG. 1.

With further reference to FIG. 8, the arrestor (24) is curved, is mounted under the bottom of the end cap (20), is capable of moving along a longitudinal direction, has two ends, a bottom and two optional stop legs (240) and may be mounted in the receiving recess (212). The bottom of the arrestor (24) has a bevel section (241) and a one-way toothed section (242). The bevel section (241) is formed on the bottom of the arrestor (24). The one-way toothed section (242) is formed on the bottom of the arrestor (24) between the bevel section (24) and one of the ends of the arrestor (24). The stop legs (240) are formed respectively at the ends of the arrestor (24) to abut the inner wall of the receiving recess (212) to allow the arrestor (24) to move along the longitudinal direction.

The guide tab (200) is formed on and protrudes down from the bottom surface of the end cap (20) and is mounted around the connecting tube (23). The connecting lip (201) is curved, is mounted around the outer edge of the end cap (20), defines a curved gap (202) between the outer edge of the end cap (20) and the connecting lip (201) and has a proximal end. The proximal end of the connecting lip (201) is formed on and protrudes radially from the outer edge of the end cap (20). The end cap connector (21) is mounted detachably on the outer edge of the end cap (20), connects to the stationary to which the base connector (33) is connected to hold the end cap (20) on the stationary and has an inside surface, multiple optional through holes (211), multiple optional fasteners and an optional connecting groove (210). The through holes (211) are formed transversely through the end cap connector (21). The fasteners extend respectively through the through holes (211) and attach to the stationary to attach the end cap connector (21) to the stationary. The connecting groove (210) is formed in the inside surface of the end cap connector (21) to selectively hold the connecting lip (201) of the end cap (20) to mount the end cap (20) on the end cap connector (21).

With further reference to FIG. 4, the rolling assembly (40) is mounted rotatably between the base (30) and the end cap (20) and has an optional connecting bushing (43), a rolling tube (42) and a rolling bushing (41).

The connecting bushing (43) is mounted rotatably on the base (30) around the connecting tube (31) and has a top edge and a keyway (431). The keyway (431) is formed longitudinally through the connecting bushing (41) and communicates with the top edge of the connecting bushing (41).

The rolling tube (42) is mounted rotatably around the drive shaft (10) and has an inner surface, an outer surface, a bottom end, a top end, an optional mounting groove (421) and an optional mounting rod (44). The bottom end of the rolling tube (42) is mounted rotatably on the base (30) around the connecting tube (31) and may be connected securely to the connecting bushing (41) to mount the rolling tube (42) rotatably on the base (30).

The mounting groove (421) is formed longitudinally in the outer surface of the rolling tube (42) and protrudes in from the inner surface of the rolling tube (42) to form a longitudinal rib. The longitudinal rib has a bottom end and a top end. The bottom end of the longitudinal rib is held in the keyway (431) in the connecting bushing (41) to securely connect the rolling tube (42) to the connecting bushing (41). The mounting rod (44) is mounted in the mounting groove (421).

Figure 11:
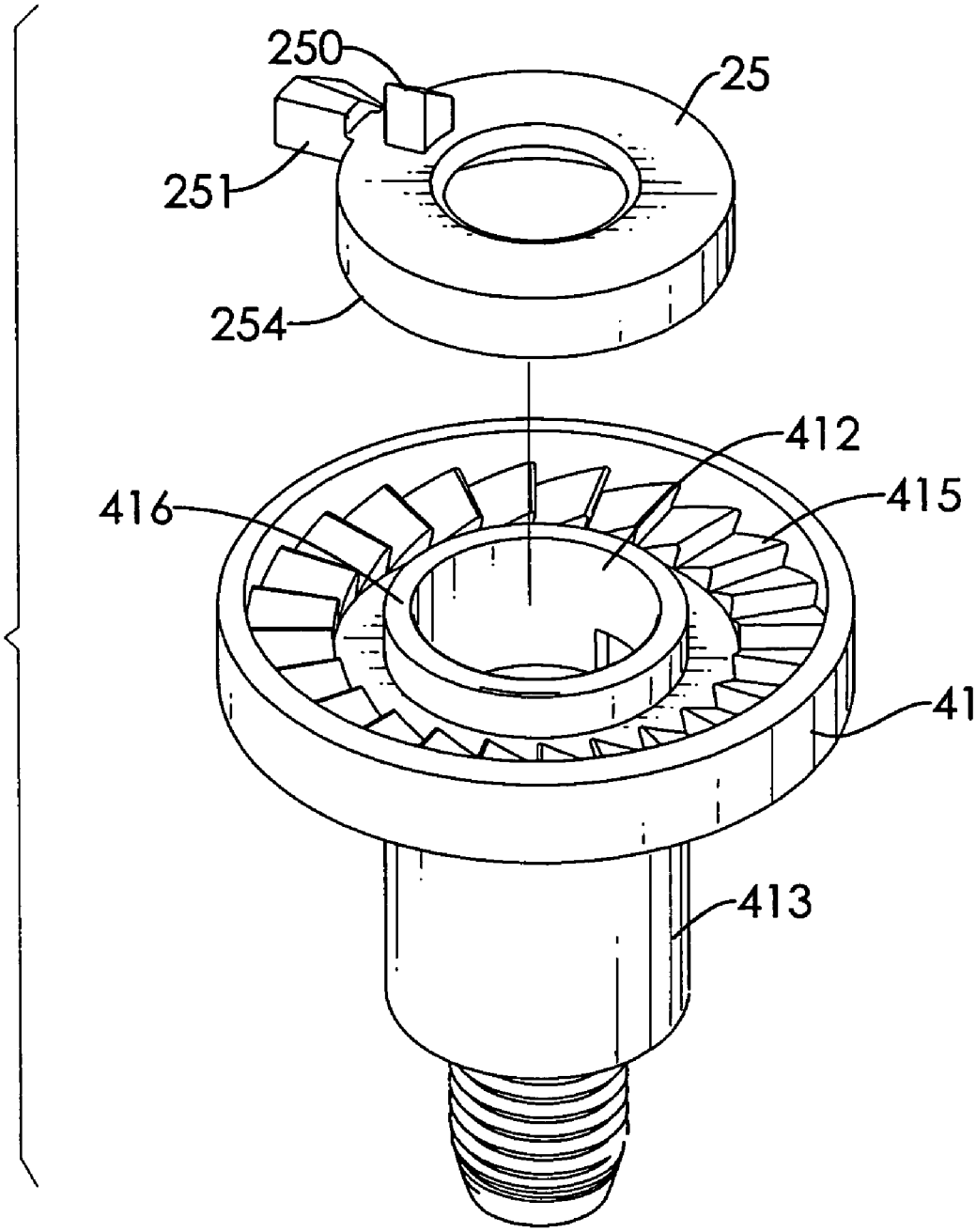
FIG. 11 is an exploded view of a first embodiment of a rolling bushing of the roll-up barrier in FIG. 1.
Figure 12:
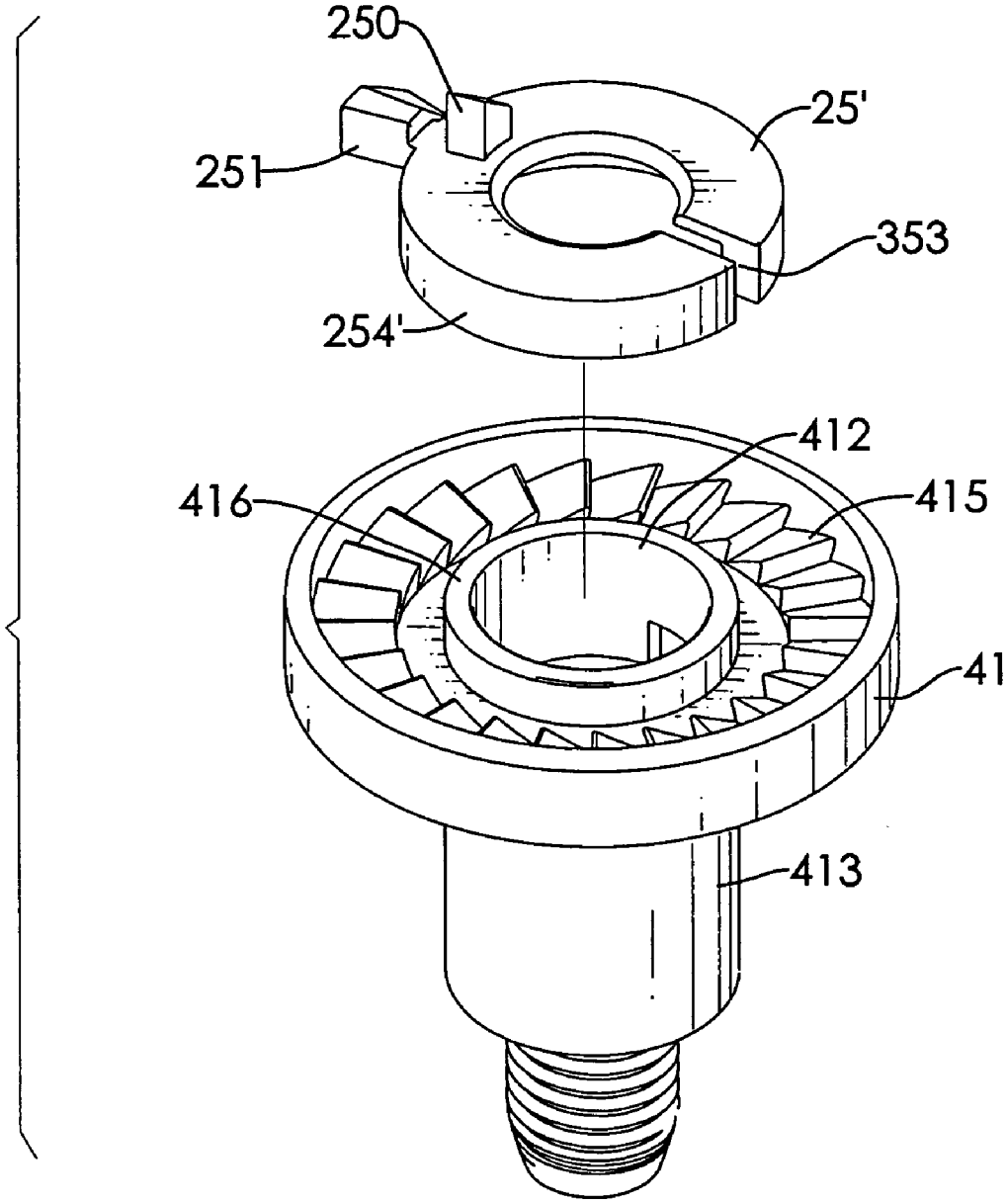
FIG. 12 is an exploded view of a second embodiment of the rolling bushing of the roll-up barrier in FIG. 1.

With further reference to FIGS. 11 and 12, the rolling bushing (41) is mounted securely at the top end of the rolling tube (42) and has a top, a bottom, an outer wall (413), a connecting hole (412), an optional connecting ring (416), an actuator (25, 25'), multiple one-way arresting teeth (415) and an optional keyway (411). The connecting hole (412) is formed coaxially through the rolling bushing (41) and is rotatably mounted around the connecting tube (23) of the end cap (20). The connecting ring (416) is formed on and protrudes from the top of the rolling bushing (41) around the connecting hole (412) and has an outer diameter.

The actuator (25, 25') is mounted rotatably on the top of the rolling bushing (41), has a top surface, an outer edge, a central hole, a control tooth (250) and an actuating lug (251) and may be implemented in several ways. The central hole is formed coaxially through the actuator (25, 25') and is mounted rotatably around the connecting tube (23) of the end cap (20). The control tooth (250) is formed on the top surface of the actuator (25, 25'), corresponds to the control serrations (220) and protrudes through the limit slot (215) to selective engage the control serrations (220).

Figure 10:
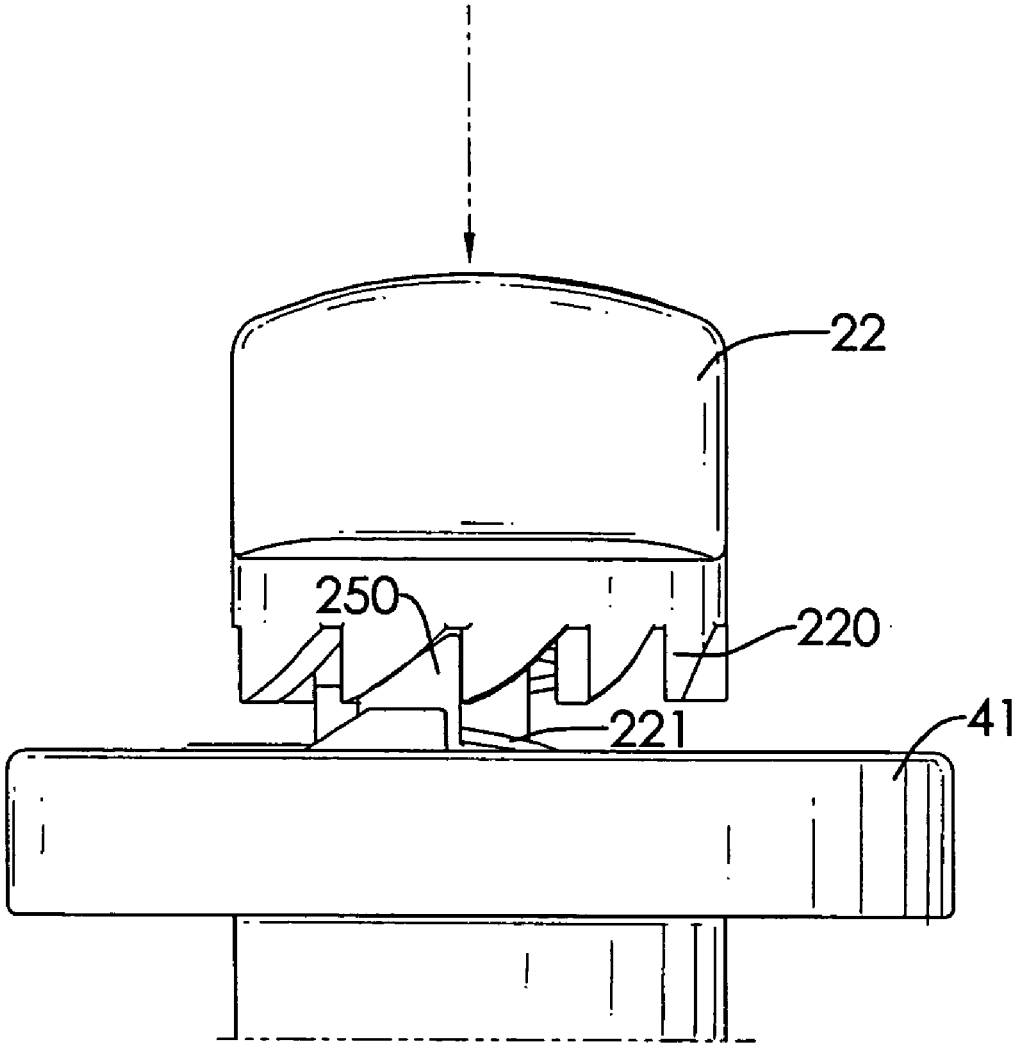
FIG. 10 is an operational front view of the arresting mechanism in FIG. 7.

With further reference to FIG. 10, when the control button (22) is pressed down, the control serrations (220) engage the control tooth (250) such that the control button (22) and the actuator (25, 25') can be rotated simultaneously along the limit slot (215).

The actuating lug (251) is formed on and protrudes radially from the outer edge of the actuator (25, 25') and has a bevel top (252). The bevel top (252) corresponds to the bevel section (241) of the arrestor (24) and selectively engages the bevel section (241) to lift up the arrestor (24).

When the actuator (25, 25') is rotated to press the control tooth (250) against one end of the limit slot (215), the bevel top (252) engages the bevel section (241) and lifts up the arrestor (24). When the actuator (25, 25') is rotated to press the control tooth (250) against the other end of the limit slot (215), the bevel top (252) departs from the bevel section (241) and lowers down the arrestor (24).

With further reference to FIG. 11, in a first embodiment of the actuator (25), the actuator (25) further has an annular flange (254). The annular flange (254) is formed on and protrudes down from the outer edge of the actuator (25), is mounted around the connecting ring (412) and has a diameter slightly larger than that of the connecting ring (412) to slightly contact with the connecting ring. Thus, friction between the annular flange (254) and the connecting ring (412) can slightly rotate the actuator (25) when the rolling bushing (41) rotates.

With further reference to FIG. 12, in a second embodiment of the actuator (25'), the actuator (25') further has an annular flange (254') and a clipping slot (253). The annular flange (254') is formed on and protrudes down from the outer edge of the actuator (25) and is mounted around the connecting ring (412). The clipping slot (253) is formed radially through the annular flange (254') and communicates with the central hole in the actuator (25'). Thus, the annular flange (254') has a slight resilience to slightly contact with the connecting ring (412) such that friction between the annular flange (254') and the connecting ring (412) can slightly rotate the actuator (25') when the rolling bushing (41) rotates.

The one-way arresting teeth (415) are formed on the top of the rolling bushing (41) around the actuator (25, 25') and corresponds to and selectively engage the one-way toothed section (242). When the arrestor (24) is lifted up by the actuating lug (251) of the actuator (25, 25'), the one-way toothed section (242) does not engage with the one-way arresting teeth (415) such that the rolling bushing (41) can rotate relative to the end cap (20). When the bevel top (252) of the actuating lug (251) departs from the bevel section (241), the arrestor (24) is lowered down and the one-way toothed section (242) engages with the one-way arresting teeth (415). Engagement between the one-way arresting teeth (415) and the one-way toothed section (242) does not allow the rolling bushing (41) to rotate relative to the end cap (20).

The keyway (411) is formed longitudinally in the outer wall (413) of the rolling bushing (41) and holds the top end of the longitudinal rib formed by the mounting groove (421) extending into the rolling tube (42).

The resilient element (11) is mounted in the rolling tube (42) to provide a rotating reposition force to roll the rolling tube (42) after the rolling tube (42) is rotated. The resilient element (11) may be mounted around the drive shaft (10) and have two ends. The ends of the resilient element (11) are connected respectively to the drive shaft (10) and the bottom of the rolling bushing (41).

Figure 9:
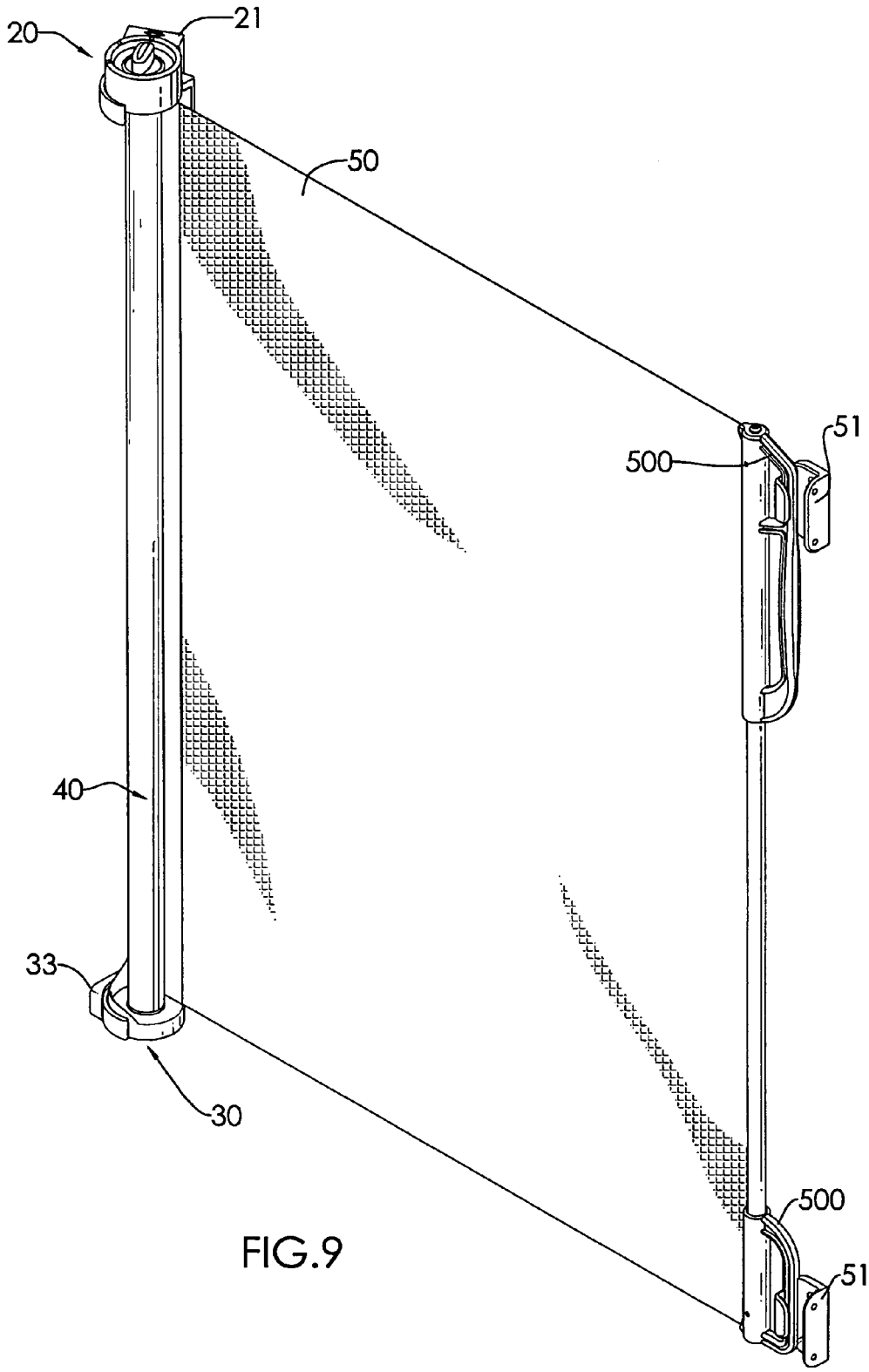
FIG. 9 is an operational perspective view of the roll-up barrier in FIG. 1.

With further reference to FIG. 9, the flexible barrier (50) is attached to and mounted retractably around the rolling tube (42) and has a proximal edge, a distal edge, a bottom edge, a top edge, two optional handles (500) and two optional connectors (51). The proximal edge of the flexible barrier (50) is attached to the rolling tube (42) and may be attached to the mounting rod (44) mounted in the mounting groove (421) in the rolling tube (42). The bottom edge of the flexible barrier (50) is guided by the guide tab (32) on the base (30), and the top edge of the flexible barrier (50) is guided by the guide tab (200) on the end cap (20) such that the flexible barrier (50) can be pulled out smoothly.

When the control button (22) is pressed down and rotated to lift up the arrestor (24), the rolling assembly (40) is allowed to be rotated such that the flexible barrier (50) can be pulled out.

After a desired length of the flexible barrier (50) is pulled out, the control button (22) can be released to detach the control serrations (220) from the control tooth (250) and to free the actuator (25, 25'). Then, the rotating reposition force stored by the resilient element (11) rolls back the rolling tube (42) and friction between the actuator (25, 25') and the top of the rolling bushing (41) slightly rotates the actuator (25, 25') to detach the bevel top (252) of the actuating lug (251) from the bevel section (241), such that the arrestor (24) is immediately moved down to engage the one-way arresting teeth (415) with the one-way toothed section (242) to prevent the rolling tube (42) from rolling back. Thus, the flexible barrier (50) can be held at the desired length that is pulled out.

After use, the control button (22) can be pressed down and rotated to lift up the arrestor (24). Then, when the flexible barrier (50) is released, the rolling tube (42) is rotated by the rotating reposition force of the resilient element (11) to retracted the flexible barrier (50) back around the rolling tube (42), which is convenient to operate.

The handles (500) are mounted on the distal edge of the flexible barrier (50) respectively near the top and bottom edges of the flexible barrier (50).

The connectors (51) connect to an adjacent stationary, e.g. a wall, a doorjamb or the like and align respectively with and selectively engage the handles (500) to hold the flexible barrier (50) in an extended position.

When the handles (500) are released from the connectors (51) and the control button (22) is pressed to ensure the disengagement between the one-way arresting teeth (415) and the one-way toothed section (242), potential energy stored in the resilient element (11) rotates the rolling assembly (40) and retracts the flexible barrier (50) by rolling the flexible barrier (50) back around the rolling tube (42).

When the one-way arresting teeth (415) engage with the one-way toothed section (242), even though the flexible barrier (50) is collided with something or someone, or is pulled or dragged by the infant or the pet to inadvertently detached from the connectors (51) on the stationary, the flexible barrier (50) will keep at the original length to prevent the infant or the pet from injured by the retracting flexible barrier. Additionally, a user is convenient to immediately engage the handles (500) with the connectors (51) to reconnect the flexible barrier (50) to the stationary.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A roll-up barrier comprising:

a base having a top surface;

an outer edge; and a connecting tube formed on and protruding up from the top surface of the base;

a drive shaft having;

a bottom end mounted securely in the connecting tube of the base; and a top end;

an end cap mounted securely at the top end of the drive shaft and having a bottom surface;

an outer edge;

a connecting tube formed coaxially on and protruding down from the bottom surface of the end cap and securely holding the top end of the drive shaft; and an arresting mechanism mounted in the end cap and having a button recess formed in the end cap and having an open top and a bottom;

a control button mounted rotatably in the button recess and having a bottom; and multiple control serrations formed circularly on the bottom of the control button;

a spring mounted under the bottom of the control button to press the control button up slightly;

a limit slot being curved, formed through the bottom of the button recess and aligning with the control serrations; and an arrestor being curved, mounted under the bottom of the end cap, being capable of moving along a longitudinal direction and having two ends; and a bottom having a bevel section formed on the bottom of the arrestor; and a one-way toothed section formed on the bottom of the arrestor between the bevel section and one of the ends of the arrestor;

a rolling assembly mounted rotatably between the base and the end cap and having a rolling tube mounted rotatably around the drive shaft and having an inner surface;

an outer surface;

a bottom end mounted rotatably on the base around the connecting tube; and a top end; and a rolling bushing mounted securely at the top end of the rolling tube and having a top;

a bottom;

an outer wall;

a connecting hole formed coaxially through the rolling bushing and rotatably mounted around the connecting tube of the end cap;

an actuator mounted rotatably on the top of the rolling bushing and having a top surface;

an outer edge;

a central hole formed coaxially through the actuator and mounted rotatably around the connecting tube of the end cap;

a control tooth formed on the top surface of the actuator, corresponding to the control serrations and protruding through the limit slot to selectively engage the control serrations; and an actuating lug formed on and protruding radially from the outer edge of the actuator and having a bevel top corresponding to the bevel section of the arrestor and selectively engaging the bevel section to lift up the arrestor; and multiple one-way arresting teeth formed on the top of the rolling bushing around the actuator and corresponding to and selectively engaging the one-way toothed section;

a resilient element mounted in the rolling tube to provide a rotating reposition force to roll the rolling tube after the rolling tube is rotated; and a flexible barrier attached to and mounted retractably around the rolling tube and having a proximal edge attached to the rolling tube;

a distal edge;

a bottom edge; and a top edge.

2. The roll-up barrier as claimed in claim 1, wherein the arresting mechanism further has a receiving recess formed in the bottom surface of the end cap around the button recess and having an inner wall; and the arrestor is mounted in the receiving recess and further has two stop legs formed respectively at the ends of the arrestor to abut the inner wall of the receiving recess.

3. The roll-up barrier as claimed in claim 1, wherein the resilient element is mounted around the drive shaft and has two ends connected respectively to the drive shaft and the bottom of the rolling bushing.

4. The roll-up barrier as claimed in claim 1, wherein the base further has a guide tab formed on and protruding up from the top surface of the base and mounted around the connecting tube;

the end cap further has a guide tab formed on and protruding down from the bottom surface of the end cap and mounted around the connecting tube;

the bottom edge of the flexible barrier is guided by the guide tab on the base; and the top edge of the flexible barrier is guided by the guide tab on the end cap.

5. The roll-up barrier as claimed in claim 1, wherein the base further has a base connector mounted detachably on the outer edge of the base; and the end cap further has an end cap connector mounted detachably on the outer edge of the end cap.

6. The roll-up barrier as claimed in claim 1, wherein the rolling assembly further has a connecting bushing mounted rotatably on the base around the connecting tube and having a top edge; and a keyway formed longitudinally through the connecting bushing and communicating with the top edge of the connecting bushing;

the bottom end of rolling tube is connected securely to the connecting bushing;

the rolling tube further has a mounting groove formed longitudinally in the outer surface of the rolling tube and protruding from the inner surface of the rolling tube to form a longitudinal rib, and the longitudinal rib having a bottom end held in the keyway in the connecting bushing; and a top end; and a mounting rod mounted in the mounting groove;

the rolling bushing further has a keyway formed longitudinally in the outer wall of the rolling bushing and holding the top end of the longitudinal rib; and the proximal edge of the flexible barrier is attached to the mounting rod.

7. The roll-up barrier as claimed in claim 1, wherein the flexible barrier further has two handles mounted on the distal edge of the flexible barrier respectively near the top and bottom edges of the flexible barrier; and two connectors aligning respectively with and selectively engaging the handles to hold the flexible barrier in an extended position.

8. The roll-up barrier as claimed in claim 1, wherein the rolling bushing further has a connecting ring formed on and protruding from the top of the rolling bushing around the connecting hole and having an outer diameter; and the actuator further has an annular flange formed on and protruding down from the outer edge of the actuator, mounted around the connecting ring and having an outer diameter slightly larger than that of the connecting ring to slightly contact with the connecting ring.

9. The roll-up barrier as claimed in claim 1, wherein the rolling bushing further has a connecting ring formed on and protruding from the top of the rolling bushing around the connecting hole; and the actuator further has an annular flange formed on and protruding down from the outer edge of the actuator and mounted around the connecting ring; and a clipping slot formed radially through the annular flange and communicating with the central hole in the actuator.

* * * * *